US005487422A

United States Patent [19]

Bertva et al.

[11] Patent Number: 5,487,422

[45] Date of Patent: Jan. 30, 1996

[54] MOUNTING BRACKET FOR A HEAT EXCHANGER

[75] Inventors: John T. Bertva, Colleyville; Scott L. Hutto; John M. McCrady, both of Burleson, all of Tex.

[73] Assignee: Wynns Climate Systems, Inc., Fort Worth, Tex.

[21] Appl. No.: 186,290

[22] Filed: Jan. 25, 1994

[51] Int. Cl.[6] ..... F28F 9/00

[52] U.S. Cl. ..... 165/67; 165/153; 180/68.4

[58] Field of Search ..... 165/67, 153, 173; 180/68.4

[56] References Cited

U.S. PATENT DOCUMENTS

| | | | |
|---|---|---|---|
| 1,737,057 | 11/1929 | Muir | 180/68.4 |
| 4,569,390 | 2/1986 | Knowlton et al. | 165/153 X |
| 5,069,275 | 12/1991 | Suzuki et al. | 165/67 |
| 5,125,454 | 6/1992 | Creamer et al. | 165/173 |
| 5,127,466 | 7/1992 | Ando | 165/067 |
| 5,139,080 | 8/1992 | Bolton et al. | 165/067 |
| 5,183,103 | 2/1993 | Tokutake | 165/67 |
| 5,205,349 | 4/1993 | Nagao et al. | 165/67 |
| 5,236,042 | 8/1993 | Kado | 165/173 X |
| 5,240,068 | 8/1993 | Tokutake | 165/67 |

FOREIGN PATENT DOCUMENTS

| | | | |
|---|---|---|---|
| 164694 | 7/1991 | Japan | 165/67 |

*Primary Examiner*—Leonard R. Leo

*Attorney, Agent, or Firm*—James E. Bradley; Grady K. Bergen

[57] ABSTRACT

An air conditioning condenser is provided with a pair of oppositely disposed headers having an exterior wall between which a plurality of substantially flat parallel flow tubes are disposed for providing fluid communication between the headers. The flow tubes are flat and have opposite side edges which are located on opposite sides of the condenser. At least one mounting bracket is attached to the air conditioning condenser. The mounting bracket is formed from a pair of opposite bracket members. The bracket members each have a header engagement portion and an inwardly protruding tube engagement portion. The header engagement portion of each bracket member has an inner wall for contacting the exterior wall of one of the headers so that when the bracket members are joined together, the header is held between the inner walls of the header engagement portions. The tube engagement portion of each bracket member terminates in an inner face and has a plurality of slots. Each slot extends outward from the inner face and is parallel to the flow tubes for receiving one of the side edges of the flow tubes when the bracket members are joined together. A mounting flange is joined to each bracket member for mounting the heat exchanger to an appropriate support structure.

13 Claims, 3 Drawing Sheets

MOUNTING BRACKET FOR A HEAT EXCHANGER

BACKGROUND OF THE INVENTION

1. Field of the Invention

This invention relates in general to a heat exchanger, and in particular to a mounting bracket for mounting the heat exchanger.

2. Description of the Prior Art

Parallel flow air conditioning condensers used in automobiles are formed from a pair of headers between which a plurality of substantially flat, parallel flow tubes are joined. The flow tubes provide fluid communication between the headers so that refrigerant can be passed back and forth between the headers through banks of the parallel flow tubes where the refrigerant is cooled and eventually condensed.

Numerous designs for mounting brackets used for mounting these air conditioning condensers have been employed in the past. Often the condenser must be modified or specifically designed with appropriate structures in order to facilitate attachment of the mounting brackets. This commonly involves forming holes, slots, grooves, indentions, flanges or protuberances on the header of the air conditioning condenser to engage the mounting bracket so that it is securely fastened to the header. These modifications to the header increase the time and expense involved in constructing the air conditioning condenser.

What is needed is a mounting bracket which can be easily and securely mounted to an air conditioning condenser or heat exchanger without the necessity of having to modify or specially construct the condenser to facilitate the addition of a mounting bracket.

SUMMARY OF THE INVENTION

A heat exchanger is provided having a pair of oppositely disposed, substantially cylindrical headers with a circular or curved exterior wall. A plurality of substantially flat, parallel flow tubes are disposed between each of the headers for providing fluid communication between the headers. The flow tubes have opposite side edges which are located on opposite sides of the heat exchanger.

There is at least one mounting bracket which is comprised of a pair of opposite bracket members which are joined together. Each of the bracket members has a header engagement portion with a concave inner wall for contacting the exterior wall of one of the headers. The bracket members are joined together so that the header is held between the inner walls of the header engagement portions of the bracket members.

Each bracket member is also provided with an inwardly protruding tube engagement portion and a mounting flange. Each of the inwardly protruding tube engagement portions terminates in an inner edge. A plurality of slots formed in the tube engagement portion extend outward from the inner edge and are parallel to the flow tubes so that the slots receive the side edges of the flow tubes when the bracket members are joined together. The mounting flanges extend parallel to the side edges of flow tubes and are located on opposite sides of the heat exchanger.

DETAILED DESCRIPTION OF THE INVENTION

Figure 1:
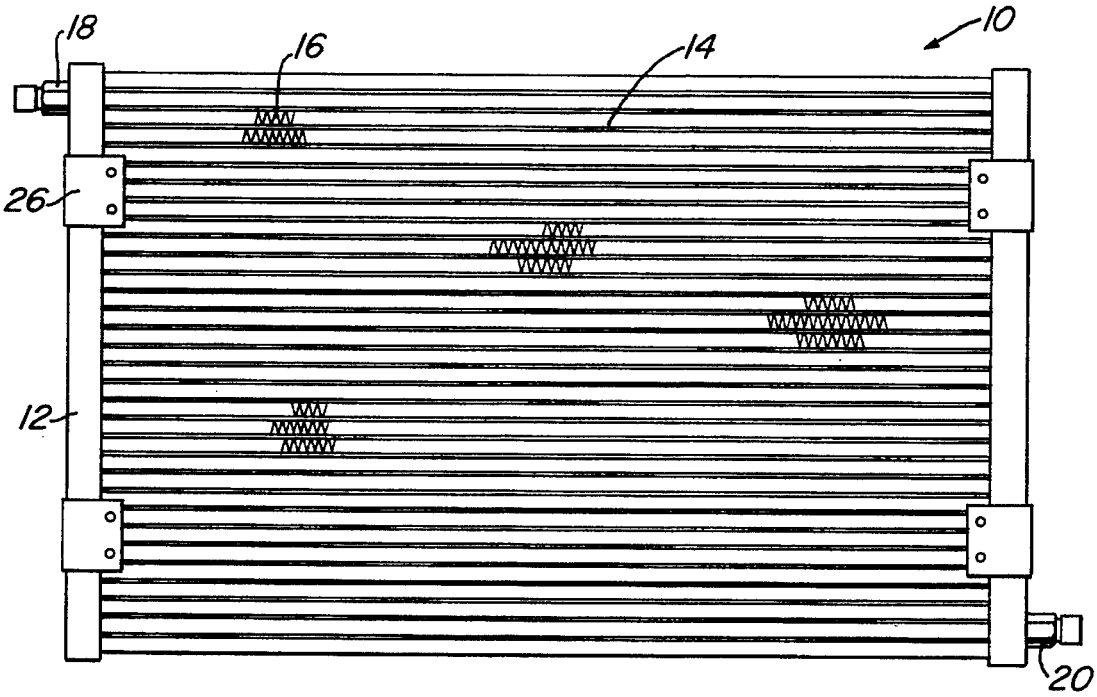
FIG. 1 is a side elevational view of a heat exchanger constructed in accordance with the invention.

Referring to the figures, FIG. 1 shows an air conditioning condenser 10 of the type used in an automobile. The air conditioning condenser 10 is provided with a pair of oppositely disposed headers 12, which are hollow conduits. A plurality of substantially flat, parallel flow tubes 14 are located between the headers 12 for providing fluid communication between each of the headers 12. Corrugated fins 16 are positioned between each of the flow tubes 14 to provide a heat exchange surface for convective heat transfer. Although not shown in FIG. 1, the corrugated fins 16 extend substantially the entire length of the tubes 14.

An inlet fitting 18 is joined to one of the headers 12 to allow refrigerant to be introduced into the condenser 10. Partitions or baffles (not shown) are placed within the headers 12 to divert fluid flow through banks of the parallel flow tubes 14 so that the refrigerant is passed back and forth between the headers 12. The refrigerant is cooled and eventually condensed as cooling air passes over the tubes 14 and fins 16 of the condenser 10. The condensed refrigerant eventually exits the condenser 10 through outlet fitting 20. The condenser 10 has a forward side and a rearward side relative to the direction of air movement over the condenser 10.

Figure 2:
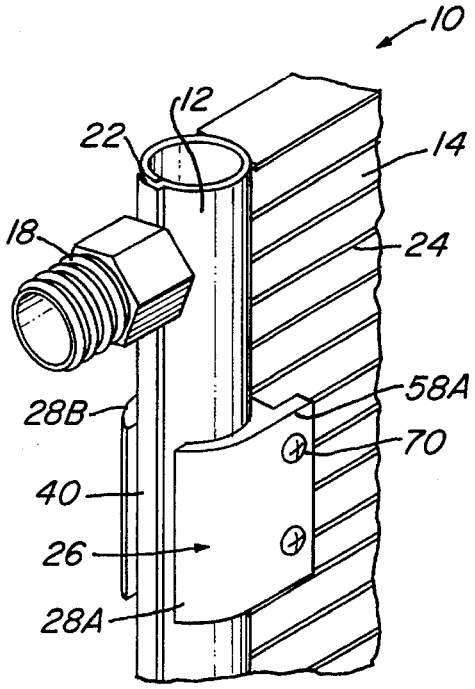
FIG. 2 is a perspective view of the heat exchanger of FIG. 1 showing a header pipe and mounting bracket constructed in accordance with the invention.

Referring to FIG. 2, the header 12 shown is a substantially cylindrical tube having a longitudinal axis and formed from a single piece of rolled aluminum which is joined along its edges to form a longitudinally extending seam 22. The seam 22 protrudes from the exterior wall of the header 12 opposite the flow tubes 14. The flow tubes 14 are joined to the header 12 and oriented so that the flow tubes 14 are perpendicular to the longitudinal axis of each of the headers 12. The flow tubes 14 are substantially flat and have opposite side edges 24 which are located on forward and rearward sides of the condenser 10.

Figure 3:
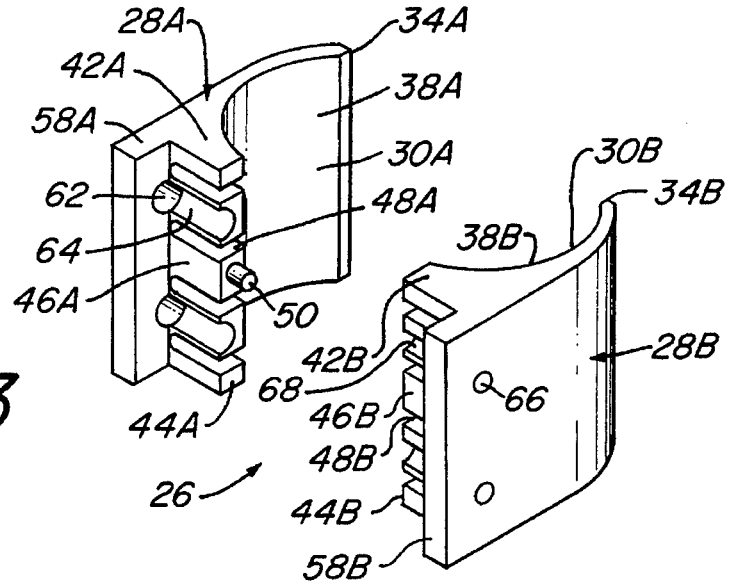
FIG. 3 is a perspective view of the mounting bracket of FIG. 2 constructed in accordance with the invention.
Figure 4:
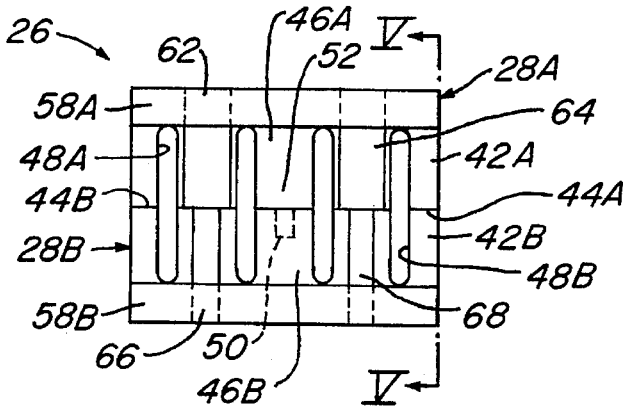
FIG. 4 is an elevational view of the mounting bracket of FIG. 2.

The air conditioning condenser 10 is mounted to an appropriate support structure (not shown) by means of mounting brackets 26 which are mounted to the header 12 at various positions. The construction of the mounting brackets 26 is shown in more detail in FIGS. 2–6. Each of the mounting brackets 26 comprises opposite, mating bracket members 28A, 28B (FIGS. 3–4). The bracket members 28A, 28B are formed from a durable plastic material, such as fiberglass filled nylon, although other materials may also be used. In general, the bracket members 28A, 28B are similar in design to each other with similar components of the bracket members 28A, 28B being designated by the same numeral and an A or B to indicate bracket members 28A, 28B, respectively.

Each of the bracket members 28A, 28B has a header engagement portion 30A, 30B. The header engagement portion 30A, 30B is formed from a curved flange which terminates in a free end 34A, 34B having a beveled edge. The header engagement portion 30A, 30B on each bracket member 28A, 28B is provided with a concave inner wall 38A, 38B which contacts the exterior wall of the headers 12. The radius of curvature of the inner wall 38A, 38B of each header engagement portion 30A, 30B is slightly less than the radius of curvature of the exterior wall of each of the headers 12. This ensures that the inner walls 38A, 38B frictionally contact the exterior wall of the headers 12 when the bracket members 28A, 28B are joined together. The free ends 34A, 34B of the header engagement portions 30A, 30B are spaced a distance apart to define a space 40 (FIG. 5).

Each bracket member 28A, 28B has a tube engagement portion 42A, 42B, which is adjacent to and integrally joined to the header engagement portion 30A, 30B. The tube engagement portion 42A, 42B of each bracket member 28A, 28B is a web which protrudes inward and terminates in an flat inner face or edge 44A, 44B. The terms "inner" and "inward" are used herein for convenience and refer generally to that direction toward the opposite bracket member 28A, 28B when the bracket members are joined together. Likewise, the term "outward" refers to the direction away from the opposite bracket member 28A, 28B. The flat inner edges 44A, 44B are parallel and abut against each other when the bracket members 28A, 28B are joined together. A flat side wall 46A, 46B, which is perpendicular to the inner edge 44A, 44B, extends outward from the inner edge 44A, 44B opposite the header engagement portion 30A, 30B.

Figure 5:
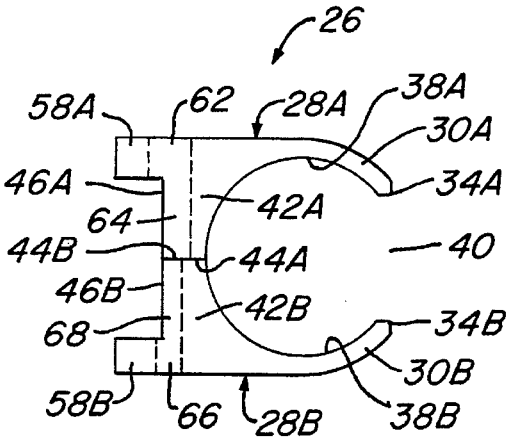
FIG. 5 is a top plan view of the mounting bracket of FIG. 4 taken along the lines V—V.

As shown in FIG. 5, the inner wall 38A, 38B of each header engagement portion 30A, 30B curves from the free end 34A, 34B and terminates at the inner edge 44A, 44B of the tube engagement portion 42A, 42B opposite the side wall 46A, 46B. Thus, when the bracket members 28A, 28B are joined together, the inner walls 38A, 38B abut at the inner edges 44A, 44B, so that the inner walls 38A, 38B define a substantially continuous wall. Because the free ends 34A, 34B of the header engagement portions 30A, 30B are spaced a distance apart to define the space 40, the header engagement portions 30A, 30B do not extend around the entire circumference of the header 12 when the bracket members 28A, 28B are joined together.

Figure 6:
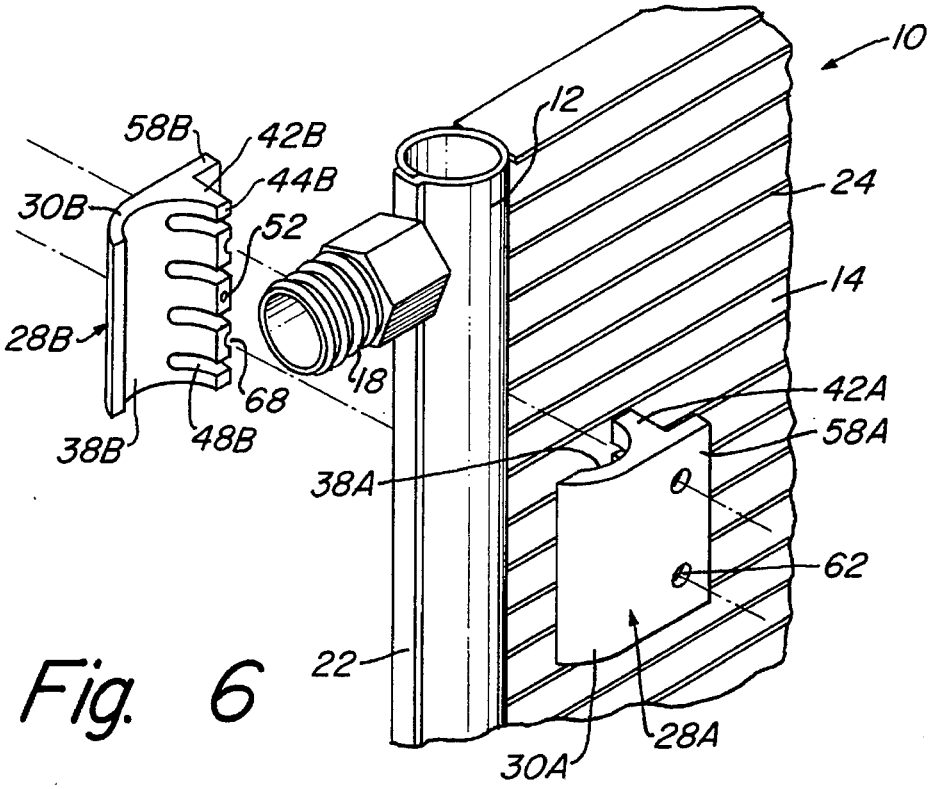
FIG. 6 is a perspective view of the heat exchanger shown with bracket members of the mounting bracket exploded apart.

Parallel slots 48A, 48B (FIG. 4) which are longitudinally spaced apart and formed in the tube engagement portions 42A, 42B, extend outward from the inner edge 44A, 44B a distance sufficient to receive the side edges 24 of the tubes 14 when the bracket members 28A, 28B are joined together. The slots 48A, 48B are parallel to the flow tubes 14 when the mounting bracket 26 is mounted to the header 12 and extend through the entire thickness of the tube engagement portions 42A, 42B, from the side wall 46A, 46B to the inner wall 38A, 38B of the header engagement portion 30A, 30B adjacent to the inner edge 44A, 44B (FIG. 6). The slots 48A, 48B are sized to closely receive the flow tubes 14 when the mounting bracket 26 is mounted to the condenser 10.

Joined to the inner edge 44A of the tube engagement portion 42A of bracket member 28A is a locator pin 50 which protrudes inward from the inner edge 44A. The inner edge 44B of opposite bracket member 28B has a corresponding recess 52, as shown in FIGS. 4 and 6, which receives the locator pin 50 when the inner edges 44A, 44B abut one another and the bracket members 28A, 28B are joined together.

Integrally joined to the tube engagement portions 42A, 42B and extending opposite the header engagement portion 30A, 30B on each mounting bracket 26A, 26B are mounting flanges 58A, 58B. The mounting flanges 58A, 58B are substantially rectangular in shape and perpendicular to the side wall 46A, 46B of the tube engagement portion 42A, 42B. When installed on condenser 10, the mounting flanges 58A, 58B will be parallel to the forward and rearward sides of condenser 10. Each mounting flange 58A, 58B will be located in a plane that contains the side edges 24 of the flow tubes 14.

Formed in the bracket member 28A are two circular holes 62 which are longitudinally spaced apart. The holes 62 extend through the mounting flange 58A and the tube engagement portion 42A, with the sidewall 46A of the tube engagement portion 30A having concave recesses 64 which are aligned with the holes 62 and have the same radius of curvature as the holes 62. The concave recesses 64 serve as clearances for fasteners extending through the holes 62.

Two circular holes 66 are also formed in the bracket member 28B. The holes 66 are concentric with the holes 62 when the bracket members 28A, 28B are joined together. The holes 66, however, have smaller diameters than the holes 62. Likewise, concave recesses 68 are also formed in the sidewall 46B. The concave recesses 68 are aligned with the holes 66, and each has a radius of curvature which is equal to the radius of the holes 66 in bracket member 28B.

To mount the mounting bracket 26 to the air conditioning condenser 10, the bracket members 28A, 28B are positioned on opposite sides of the air conditioning condenser 10 so that the slots 48A, 48B of each bracket member 28A, 28B are aligned with opposite side edges 24 of the flow tubes 14 and the mounting flanges 58A, 58B extend parallel to a plane containing the side edges 24 of the flow tubes 14. The header 12 is positioned between the inner walls 38A, 38B of the header engagement portions 30A, 30B. The tube engagement portions 42A, 42B are then brought together and inserted into the parallel flow tubes 14 with the slots 48A, 48B receiving the opposite side edges 24.

A fastener 70 (FIG. 2) serves as fastening means for joining the bracket members 28A, 28B together. In the embodiment of the mounting bracket 26 shown in FIGS. 2–6 the bracket members 28A, 28B are constructed to accommodate a self-threading type screw. Because the hole 66 in bracket member 28B is smaller than the hole 62, a self-threading screw is inserted through the hole 62 and used to tap threads into the concave portion 68 and hole 66 of bracket member 28B and securely join the bracket members 28A, 28B together.

When the bracket members 28A, 28B are properly positioned and joined together, the locator pin 50 on the inner edge 44A is received within the recess 52 formed on the inner edge 44B of the bracket member 28B. The inner edges 44A, 44B abut against one another, and the inner walls 38A, 38B of the header engagement portions 30A, 30B contact the header 12 on opposite sides. The smaller radius of curvature of the concave inner walls 38A, 38B of the header engagement portions 30A, 30B relative to the radius of curvature of the exterior wall of the header 12 ensures that the header engagement portions 30A, 30B contact the header 12 so that it is frictionally held between the inner walls 38A, 38B of the bracket members 28A, 28B. The space 40 between the free ends 34A, 34B of the header engagement portions 30A, 30B accommodates the protruding seam 22 which extends along the length of the header 12. The mounting flanges 58A, 58B extend for a selected distance alongside and parallel to the side edges 24 of the flow tubes 14, each mounting flange 58A, 58B being located on opposite sides of the condenser 10 when the bracket members 28A, 28B are joined together.

Once the mounting brackets 26 are mounted to the condenser 10, the air conditioning condenser 10 can be mounted to an appropriate support structure by means of the mounting flanges 58A, 58B.

Figure 7:
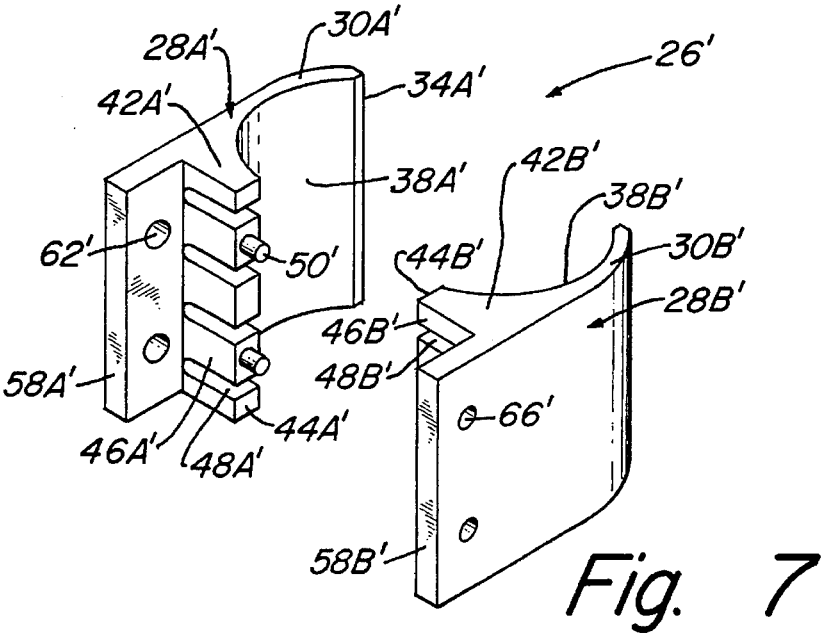
FIG. 7 is another embodiment of a mounting bracket for the heat exchanger of FIG. 1 constructed in accordance with the invention.

In another embodiment shown in FIG. 7, a mounting bracket 26', which is similar to the mounting bracket 26 shown in FIGS. 2–6, is provided with similar components designated by a prime sign. The mounting bracket 26' has two locator pins 50' located on the inner edge 44A'. Holes 62' and 66' are formed entirely in the mounting flanges 58A', 58B' so that there is no need to form recesses in the tube engagement portions 42A', 42B'. The assembly and operation of the mounting bracket 26' is substantially the same as for the mounting bracket 26 of FIGS. 2–6.

This invention has advantages over the prior art. There is no need to modify or specially construct the air conditioning condenser in order to accommodate the mounting bracket as in other prior art designs. The mounting bracket is merely mounted to the condenser after its construction. This reduces the amount of time and expense necessary to construct the condenser. There is no need to form holes, slots, grooves, flanges or protuberances on the headers. The bracket members are merely joined together so that the header is frictionally held between the inner walls of the header engagement portions.

While the invention has been shown in only two of its forms, it should be apparent to those skilled in the art that it is not so limited, but is susceptible to various changes without departing from the scope of the invention.

We claim:

1. In a heat exchanger having a forward side and rearward side, a pair of oppositely disposed headers, each header having an exterior wall, a plurality of substantially flat parallel flow tubes disposed between the headers for providing fluid communication between the headers, the flow tubes having opposite side edges located on the forward and rearward sides of the heat exchanger, at least one mounting bracket, comprising:

forward and rearward bracket members, each bracket member having a header engagement portion and a tube engagement portion, the header engagement portion having an inner wall which fits flush around a portion of the exterior wall of one of the headers, the tube engagement portion of the forward bracket member extending rearward and the tube engagement portion of the rearward bracket member extending forward, each tube engagement portion terminating in an inner face, and each tube engagement portion having at least one slot which extends from the inner face and which is parallel to the flow tubes for receiving one of the side edges of the flow tubes;

a mounting flange which is joined to at least one of the bracket members; and fastening means for fastening the bracket members together with the forward bracket member located on the forward side of the heat exchanger, the rearward bracket member located on the rearward side of the heat exchanger, with said one of the headers gripped by the header engagement portions, and with one of the flow tubes located in the slot; and wherein the inner face of one of the tube engagement portions has a protruding locator pin, the other of the inner faces having a recess which receives the locator pin when the bracket members are fastened together.

2. The heat exchanger of claim 1, wherein:

the headers are substantially cylindrical; and wherein the inner wall of the header engagement portion of each bracket member is concave so that the inner wall contacts the exterior wall of said one of the headers.

3. The heat exchanger of claim 2, wherein:

the inner wall of each header engagement portion has a radius of curvature which is less than that of the exterior wall of the headers.

4. The heat exchanger of claim 1, wherein:

the mounting flange extends parallel to the forward and rearward sides of the heat exchanger.

5. The heat exchanger of claim 1, wherein:

one of the mounting flanges is joined to each of the bracket members.

6. The heat exchanger of claim 1, wherein:

the fastening means comprises a fastener which extends through an aperture formed in each of the bracket members.

7. In a heat exchanger having a forward side and rearward side, a pair of oppositely disposed headers, each header having an exterior wall, a plurality substantially flat, parallel flow tubes disposed between the headers for providing fluid communication between the headers, the flow tubes having opposite side edges located on the forward and rearward sides of the heat exchanger at least one mounting bracket, comprising:

forward and rearward bracket members, each bracket member having a header engagement portion and a tube engagement portion the header engagement portion having an inner wall which fits flush around a portion of the exterior wall of one of the headers, the tube engagement portion of the forward bracket member extending rearward and the tube engagement portion of the rearward bracket member extending forward, each tube engagement portion terminating in an inner face, and each tube engagement portion having at least one slot which extends from the inner face and which is parallel to the flow tubes for receiving one of the side edges of the flow tubes:

a mounting flange which is joined to at least one of the bracket members; and fastening means for fastening the bracket members together with the forward bracket member located on the forward side of the heat exchanger, the rearward bracket member located on the rearward side of the heart exchanger, with said one of the headers gripped by the heater engagement portions, and with one of the flow tubes located in the slot; and wherein the mounting flange extends for a selected distance along the side edges of the flow tubes.

8. A heat exchanger comprising in combination: a pair of oppositely disposed substantially cylindrical headers, each header having a curved exterior wall;

a plurality of substantially flat, parallel flow tubes disposed between the headers for providing fluid communication between the headers, the flow tubes having opposite side edges located on opposite sides of the heat exchanger; and at least one mounting bracket, the mounting bracket including a pair of opposite bracket members, each bracket member having a header engagement portion, an inwardly protruding tube engagement portion and a mounting flange the header engagement portion having a concave inner wall which fits around a portion of the exterior wall of one of the headers; wherein each of the inwardly protruding tube engagement portions terminates in an inner face, the tube engagement portions each having a plurality of slots which extend from the inner face and which are parallel to the flow tubes for receiving the side edges of the flow tubes; wherein the mounting flanges extend parallel to a plane containing the side edges of the flow tubes;

fastening means for fastening the bracket members together with the header engagement portions gripping one of the headers and with the slots receiving the flow tubes; and one of the inner faces has a protruding locator pin, the other of the inner faces having a recess for receiving the locator pin when the bracket members are fastened together.

9. A heat exchanger comprising in combination:

a pair of oppositely disposed substantially cylindrical headers, each header having a curved exterior wall;

a plurality of substantially flat, parallel flow tubes disposed between the headers for providing fluid communication between the headers, the flow tubes having opposite side edges located on opposite sides of the heat exchanger; and at least one mounting bracket, the mounting bracket including a pair of opposite bracket members, each bracket member having a header engagement portion, an inwardly protruding tube engagement portion and a mounting flange, the header engagement portion having a concave inner wall which fits around a portion of the exterior wall of one of the headers; wherein each of the inwardly protruding tube engagement portions terminates in an inner face, the tube engagement portions each having a plurality of slots which extend from the inner face and which are parallel to the flow tubes for receiving the side edges of the flow tubes; wherein the mounting flanges extend parallel to a plane containing the side edges of the flow tubes;

fastening means for fastening the bracket members together with the header engagement portions gripping one of the headers and with the slots receiving the flow tubes; and the inner face of each tube engagement portion abuts against the inner face of the other tube engagement portion when the bracket members are fastened together.

10. The heat exchanger of claim 9, wherein:

the inner wall of each header engagement portion has a radius of curvature which is less than that of the exterior wall of the headers.

11. The heat exchanger of claim 9, wherein:

the fastening means comprises a fastener which extends through an aperture formed in each of the bracket members.

12. A heat exchanger comprising in combination:

a pair of oppositely disposed substantially cylindrical headers, each header having a curved exterior wall;

a plurality of substantially flat, parallel flow tubes disposed between the headers for providing fluid communication between the headers, the flow tubes having opposite edges located on opposite sides of the heat exchanger; and at least one mounting bracket, the mounting bracket including a pair of opposite bracket members, each bracket member having a header engagement portion, an inwardly protruding tube engagement portion and a mounting flange, the header engagement portion having a concave inner wall which fits around a portion of the exterior wall or one of the headers; wherein each of the inwardly protruding tube engagement portions terminates in an inner face the tube engagement portions each having a plurality of slots which extend from the inner face and which are parallel to the flow for receiving the side edges of the flow tubes; wherein the mounting flanges extend parallel to a plane containing the side edges of the flow tubes; and fastening means for fastening the bracket members together with the header engagement portions gripping one of the headers and with the slots receiving the flow tubes; and wherein the mounting flanges extend for a selected distance in contact with the side edges of the flow tubes.

13. A mounting bracket for a heat exchanger which has a forward side, a rearward side, a pair of oppositely disposed substantially cylindrical headers, a plurality of substantially flat, parallel flow tubes disposed between the headers for providing fluid communication between the headers, the mounting bracket comprising:

a pair of opposite bracket members, each bracket member having a header engagement portion, an inwardly protruding tube engagement portion and a mounting flange, the header engagement portion having a concave inner wall adapted to engage one of the headers; wherein each of the inwardly protruding tube engagement portions terminates in an inner face, one of the inner faces having an inwardly protruding locator pin, the other of the inner faces having a recess for receiving the locator pin, the tube engagement portions each having a plurality of slots which extend outward from the inner face, each of the slots adapted to receive one of the flow tubes; and at least one fastener adapted to extend from one of the bracket members into the other to fasten the bracket members together with one of the bracket members being on the forward side of the heat exchanger, the other of the bracket members being on the rearward side of the heat exchanger, the header engagement portions gripping one of the headers, the slots engaging the flow tubes, with the inner faces of the tube engagement portions abutting each other, and with the mounting flanges extending parallel to the forward and rearward sides of the heat exchanger.

* * * * *